US009086203B2

(12) United States Patent
Calderas et al.

(10) Patent No.: US 9,086,203 B2
(45) Date of Patent: Jul. 21, 2015

(54) SEALED BULB CONNECTOR SYSTEM FOR A HEADLAMP ASSEMBLY

(71) Applicant: GM GLOBAL TECHNOLOGY OPERATIONS LLC, Detroit, MI (US)

(72) Inventors: Jeffrey José Calderas, Royal Oak, MI (US); Israel J. Cancino, Jr., Santo André (BR); Douglas Fazzolari, São Paulo (BR)

(73) Assignee: GM Global Technology Operations LLC, Detroit, MI (US)

( * ) Notice: Subject to any disclaimer, the term of this patent is extended or adjusted under 35 U.S.C. 154(b) by 83 days.

(21) Appl. No.: 14/073,412

(22) Filed: Nov. 6, 2013

(65) Prior Publication Data

US 2015/0124470 A1 May 7, 2015

(51) Int. Cl.
*F21S 8/00* (2006.01)
*F21S 8/10* (2006.01)

(52) U.S. Cl.
CPC ..... *F21S 48/33* (2013.01); *F21S 48/1109* (2013.01)

(58) Field of Classification Search
CPC ..... F21S 48/33; F21S 48/1109
USPC ..... 362/519
See application file for complete search history.

(56) References Cited

U.S. PATENT DOCUMENTS

| | | | | |
|---|---|---|---|---|
| 2003/0179587 | A1* | 9/2003 | Nishiyama | 362/546 |
| 2004/0184281 | A1* | 9/2004 | Duarte et al. | 362/509 |
| 2009/0225563 | A1* | 9/2009 | Yamamoto | 362/519 |

* cited by examiner

*Primary Examiner* — Evan Dzierzynski
(74) *Attorney, Agent, or Firm* — Quinn Law Group, PLLC

(57) ABSTRACT

A headlamp assembly includes a headlamp housing, a lens affixed to the housing, thereby defining an interior space of the assembly, and a reflector defining an aperture and arranged within the interior space. The assembly also includes a retention bracket mounted to the reflector and a first seal attached to the bracket for keeping moisture from the interior space. The assembly also includes an adapter element that can be fastened or unfastened at the bracket, and a second seal arranged between the adapter and the bracket for keeping moisture from an interface between the bracket and the adapter. The assembly additionally includes a light bulb mounted to the adapter and extending through the aperture toward the lens, and a connector establishing an electrical connection with the bulb. Furthermore, the assembly includes a third seal arranged between the connector and the adapter and configured to keep moisture from the electrical connection.

20 Claims, 4 Drawing Sheets

SEALED BULB CONNECTOR SYSTEM FOR A HEADLAMP ASSEMBLY

TECHNICAL FIELD

The present disclosure relates to a sealed bulb connector for a vehicle headlamp assembly.

BACKGROUND

A headlamp is a lamp attached to the front of a vehicle to illuminate the road ahead of the subject vehicle. World-wide, vehicles have used both sealed beam headlamps and composite headlamps. Sealed beam headlamps are replaceable light bulbs that are typically not enclosed inside headlamp assemblies, while composite headlamps are lamp assemblies with replaceable bulbs that are either enclosed entirely inside or extend outside the headlamp assemblies.

Popular among modern vehicles is a headlamp design using an "H4" halogen light bulb. The H4 bulb as first introduced in Europe includes low beam and high beam filaments in a single bulb, and thus provides the capability to generate both low and high beams from a single bulb. In 1991, a "9003/HB2" bulb that is similar to the H4 bulb, but with stricter limits on bulb filament placement variance and lower allowable light output, was certified for use on vehicles sold in North America.

It may be desirable to seal headlamps using H4 and 9003/HB2 light bulbs from moisture in order to maintain effectiveness and reliability of such headlamps. Sealed headlamp assemblies may be especially useful in off road vehicles that may need to traverse a body of water.

SUMMARY

A headlamp assembly includes a headlamp housing and a lens affixed to the headlamp housing. The lens in conjunction with the headlamp housing defines an interior space of the headlamp assembly. The headlamp assembly also includes a reflector defining an aperture and arranged within the interior space. The headlamp assembly additionally includes a retention bracket mounted to the reflector, and a first seal attached to the retention bracket for sealing thereof to the headlamp housing and keeping moisture out of the interior space. The headlamp assembly also includes an adapter element configured to be selectively fastened to the retention bracket such that an interface between the adapter element and the retention bracket is generated thereby, and to be unfastened from the retention bracket. The headlamp assembly also includes a second seal arranged between the adapter element and the retention bracket. The second seal is configured to keep moisture from penetrating the interface between the bracket and the adapter. The headlamp assembly additionally includes a light bulb mounted to the adapter element and configured to extend through the aperture in the reflector toward the lens, and a connector configured to establish an electrical connection to the light bulb for communicating an electric current thereto. Furthermore, the headlamp assembly includes a third seal arranged between the connector and the adapter and configured to keep moisture from reaching the electrical connection between the light bulb and the connector.

The adapter element may be configured for selective fastening to the retention bracket by being pushed into the retention bracket such that the light bulb extends through the aperture into the reflector and then turned relative to the retention bracket. In such a case, the adapter element may be turned clockwise approximately ¼ turn relative to the retention bracket.

The light bulb may be mounted to the adapter element via a mounting plate that is fastened to the adapter element.

The first seal may be configured as a bellows. Additionally, the second seal may be configured as one of an O-ring and a gasket that is characterized by a substantially rectangular cross-section.

The connector may be arranged in line or at an angle with respect to the light bulb.

The connector may include a snap-lock arrangement. Such a snap-lock arrangement may be configured to latch the connector onto the adapter element.

The connector may be connected to an electrical cable. In such a case, the headlamp assembly may also include a fourth seal configured to seal an interface between the connector and the cable.

The headlamp assembly may be arranged on a vehicle, wherein the headlamp housing is mounted to a body of the vehicle.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
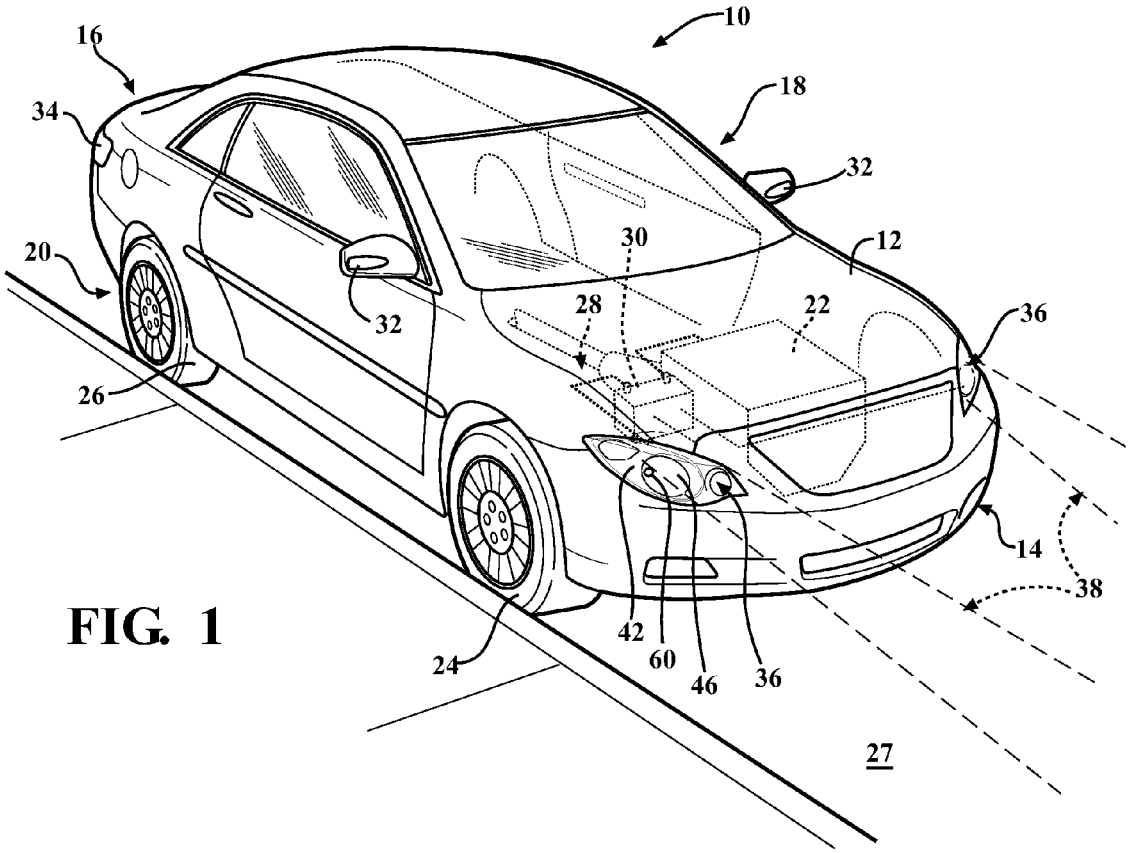
FIG. 1 is a schematic perspective illustration of a motor vehicle having a vehicle body and headlamp assemblies mounted to the body according to the disclosure.
Figure 2:
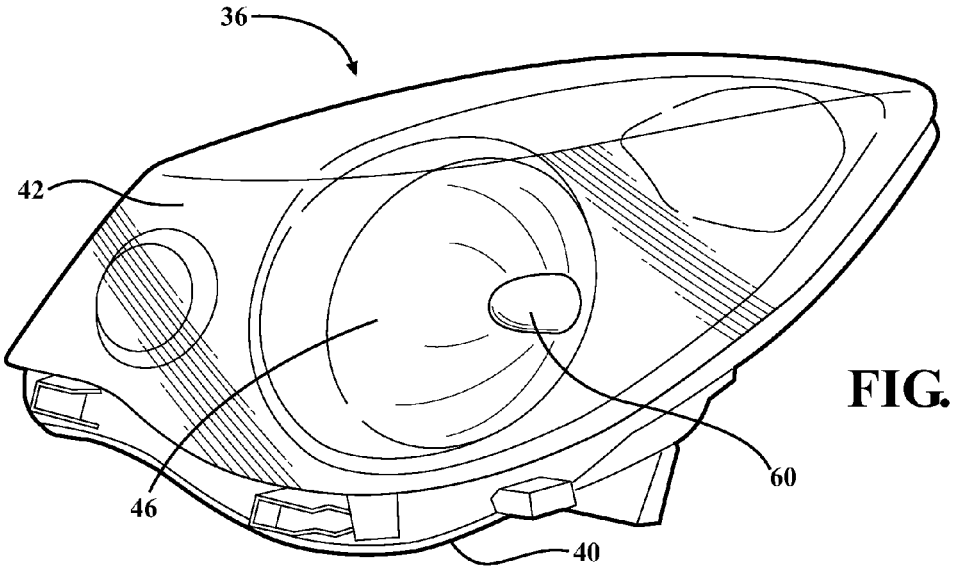
FIG. 2 is a close-up perspective view of the headlamp assembly having a replaceable light bulb, as shown in FIG. 1.

Referring to the drawings, wherein like reference numbers refer to like components, FIG. 1 shows a schematic view of a motor vehicle 10, which includes a vehicle body 12. The vehicle body 12 also includes exterior panels positioned at a front end 14, at a rear end 16, as well as at a left body side 18 and at a right body side 20. Additionally, the vehicle 10 includes a powertrain 22 configured to propel the vehicle via front wheels 24, rear wheels 26, or via all four wheels 24 and 26 down a road identified in FIG. 1 with numeral 27.

Furthermore, the vehicle 10 includes an electrical system 28 having an energy storage device 30, such as one or more batteries, configured to accept an electric charge. The electrical system 28 is configured to supply electric current to operate vehicle systems, such as exterior lighting that includes vehicle turn signal assemblies 32, tail lamp assemblies 34, headlamp assemblies 36, and, heating/ventilation/air conditioning (HVAC) and vehicle infotainment, as well as various on-board devices, such as a cellular telephone charger, etc., which are not shown, but known to those skilled in the art. The headlamps 36 are employed by the vehicle 10 to illuminate the road 27 ahead of the vehicle with projected and specifically aimed light beams 38.

As shown in FIGS. 2-5, each headlamp assembly 36 includes a headlamp housing 40 and a lens 42 affixed to the headlamp housing thereby defining an interior space 44 of the headlamp assembly. The lens 42 may be affixed to the headlamp housing 40 via various known methods, such as integrated snap-locks or stand-alone fasteners, or permanently fused thereto with structural adhesive or sealant. The headlamp assembly 36 also includes a reflector 46 defining an aperture 48 and arranged within the interior space 44. A retention bracket 50 is mounted to the reflector 46. A first seal 52, otherwise known as a "boot", is attached to the retention bracket 50. The first seal 52 may be formed from a rubber or other material that is impervious to moisture. As such, the first seal 52 is employed for sealing the retention bracket 50 to the headlamp housing 40 and keeping moisture that is frequently present in the ambient out of the interior space 44. The first seal 52 may be configured, i.e., designed and formed, as a bellows, i.e., having a flexible, accordion-style construction that permits movement of the reflector 46 relative to the headlamp housing 40. Such relative movement may be beneficial to permit shifting of the reflector in order to aim the light beam 38 without disturbing the sealed arrangement between the retention bracket 50 and the headlamp housing 40.

Figure 3:
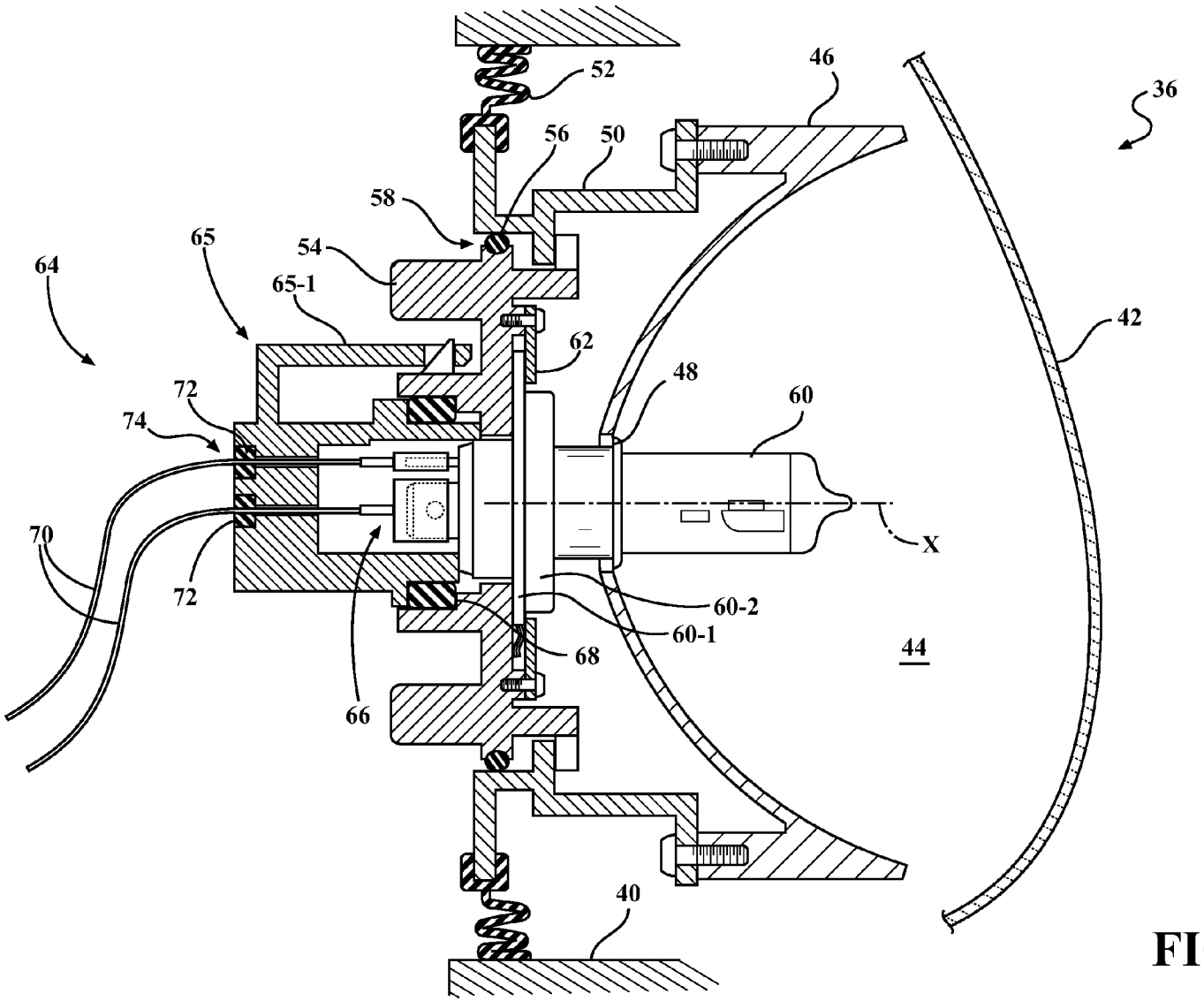
FIG. 3 is a schematic cross-sectional view of the headlamp assembly shown in FIGS. 1-2 according to an embodiment.
Figure 4:
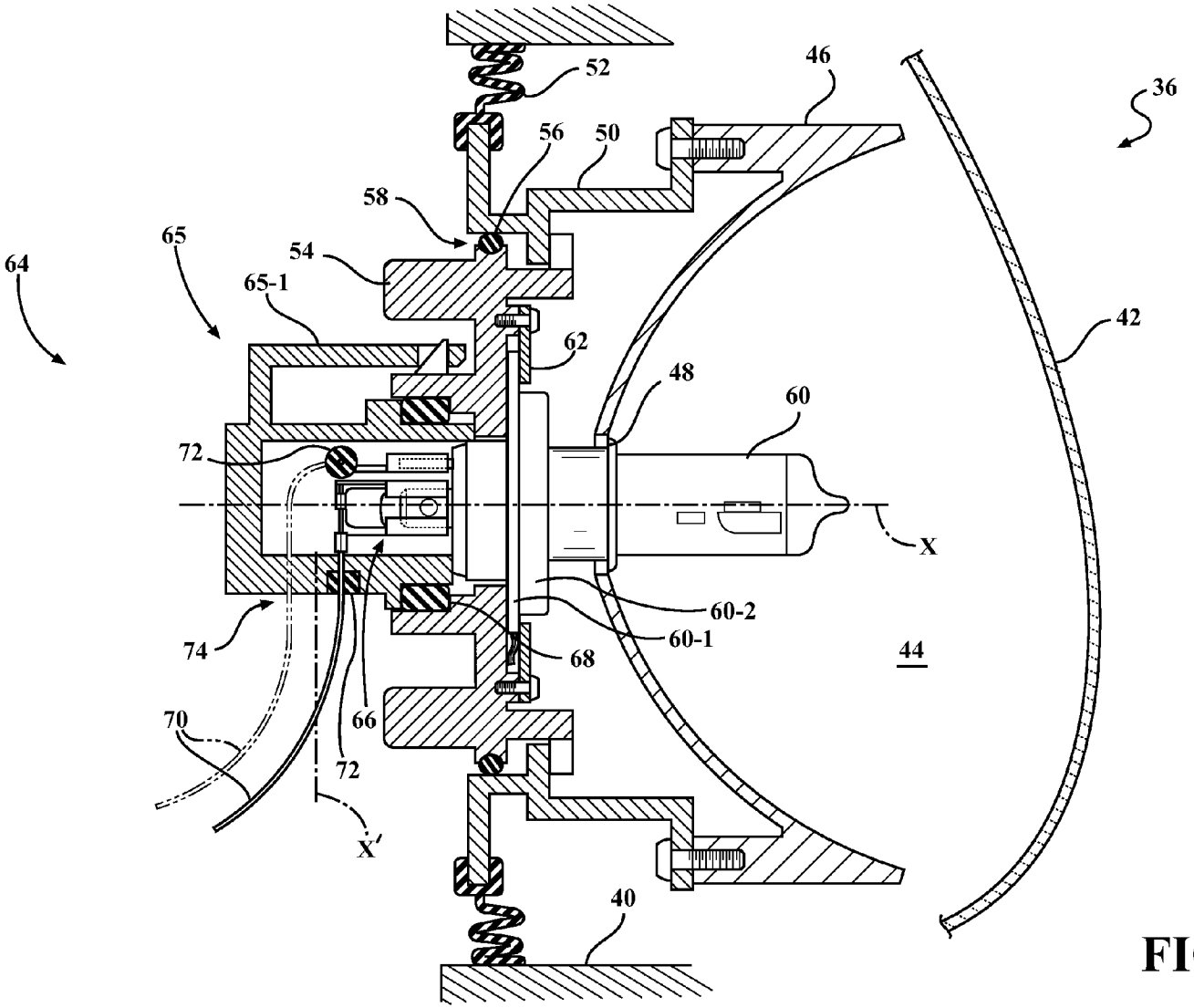
FIG. 4 is a schematic cross-sectional view of the headlamp assembly shown in FIGS. 1-2 according to another embodiment.
Figure 5:
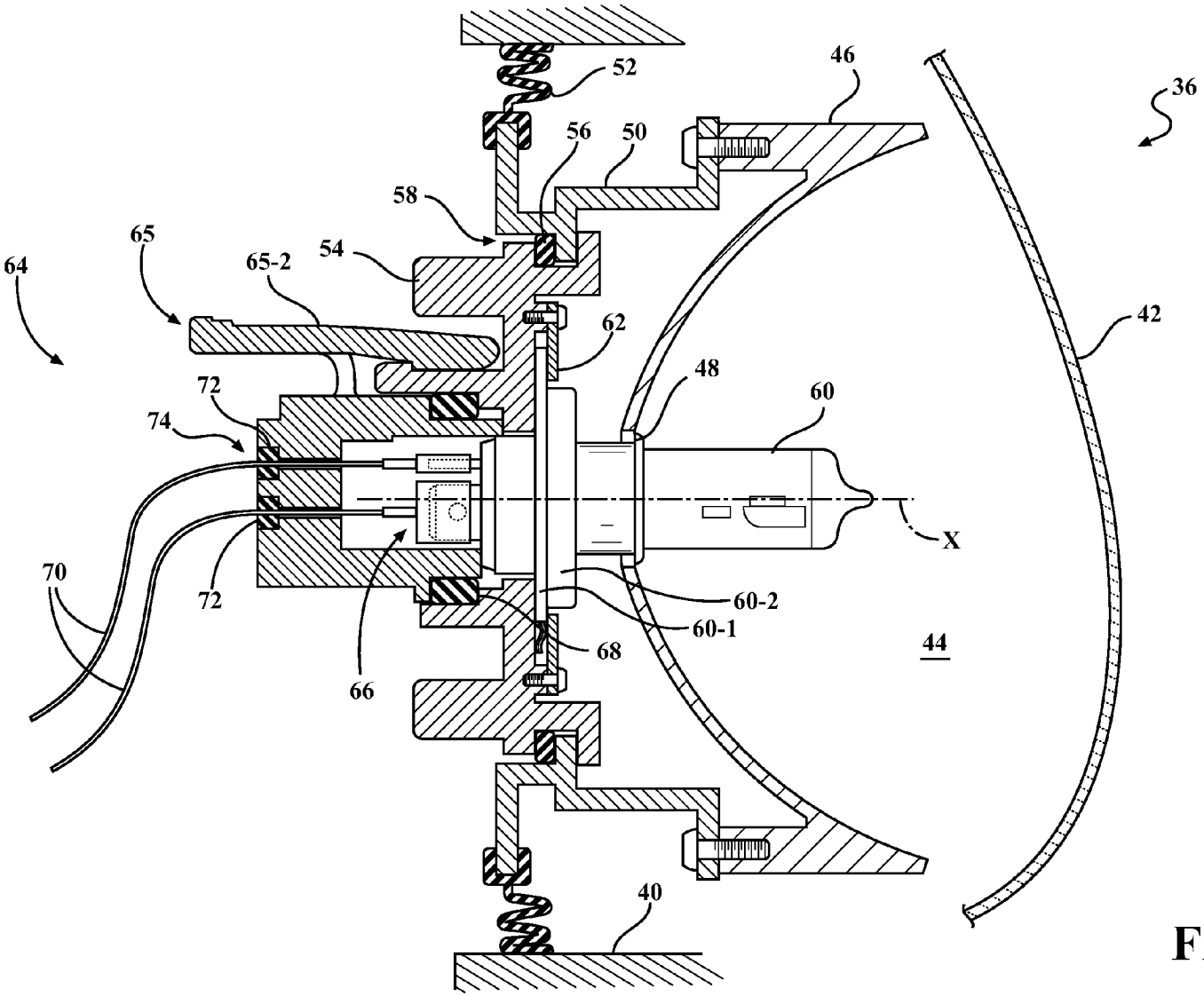
FIG. 5 is a schematic cross-sectional view of the headlamp assembly shown in FIGS. 1-2 according to yet another embodiment.

As shown in FIGS. 3-5, the headlamp assembly 36 also includes an adapter element 54 configured to be selectively fastened and unfastened relative to the retention bracket 50. A second seal 56 is arranged between the adapter element 54 and the retention bracket 50. Like the first seal 52, the second seal 56 may be formed from a rubber or other material that is impervious to moisture. As such, the second seal 56 is employed for keeping moisture from penetrating an interface 58 between the retention bracket 50 and the adapter element 54 and away from the reflector 46. The second seal 56 may be configured as an O-ring, as shown in FIG. 3, or as a gasket characterized by a substantially rectangular cross-section as shown in FIG. 5.

With continued reference to FIGS. 3-5, the headlamp assembly 36 also includes a light bulb 60 mounted to the adapter element 54 and configured to extend through the aperture 48 in the reflector 46 toward the lens 42. The light bulb 60 may be an H4 or 9003/HB2 type replaceable light bulb. As shown in FIGS. 3-5, a longitudinal axis X extends through the light bulb 60. A mounting plate 62 is fastened to the adapter element 54 to thereby fasten the light bulb 60 to the adapter element and retain the light bulb to the adapter element 54. The mounting plate 62 may retain the light bulb 60 at any surface on the light bulb housing that has an appropriate surface area and strength, such as a flange 60-1 or step 60-2 (shown in FIGS. 3-5), to retain the light bulb against the adapter element 54. A connector 64 is configured to establish an electrical connection 66 to the light bulb 60 for communicating an electric current thereto.

The connector 64 may be arranged in line with respect to the light bulb 60, i.e., substantially along the axis X, as shown in FIG. 3, along an axis X' which is at a 90 degree angle with respect to the axis X, i.e., generally perpendicular to the light bulb 60, as shown in FIG. 4, or at some other angle with respect to the axis X. The connector 64 may be configured to latch on or snap onto the adapter element 54 in order to maintain reliable contact with electrical terminals (not shown) of the light bulb 60, thereby affecting the electrical connection 66 between the light bulb 60 and the connector 64. The connector 64 may include a snap-lock arrangement 65 that is configured to latch the connector onto the adapter element 54. Shown as non-limiting examples, the snap-lock arrangement 65 may be configured with a direct-acting lock tab 65-1 (shown in FIGS. 3-4), or with a pivoting lock tab 65-2 (shown in FIG. 5) that is intended to be pushed or depressed to permit disengagement of the connector 64 from the light bulb 60.

As shown in FIGS. 3-4, the headlamp assembly 36 also includes a third seal 68 arranged between the connector 64 and the adapter element 54. The third seal 68 may be arranged either on the connector 64 or on the adapter element 54. Like the first and second seals 52 and 56, the third seal 68 may be formed from a rubber or other material that is impervious to moisture. As such, the third seal 68 is employed in order to keep moisture from reaching or penetrating the electrical connection 66 between the light bulb 60 and the connector 64, thus maintaining a sealed connector 64. The connector 64 is coupled to a plurality of electrical cables 70 that communicate electrical current from the energy storage device 30, as seen in FIG. 1, to the headlamp assembly 36 in order to generate the light beam 38 (shown in FIG. 1). The headlamp assembly 36 also includes a fourth seal 72 configured to seal an interface 74 between the connector 64 and the cables 70. The fourth seal 72 may be configured as a set of separate seals, wherein each individual seal is employed to seal each individual cable 70. Like the first, second, and third seals 52, 56, and 68, the fourth seal 72 may be formed from a rubber or other material that is impervious to moisture.

During installation of the light bulb 60 into the headlamp assembly 36, the adapter element 54 is fastened to the retention bracket 50 by being pushed into the retention bracket such that the light bulb 60 extends through the aperture 48 into the reflector 46. The adapter element 54 and the light bulb 60 mounted thereon are subsequently turned as a sub-assembly relative to the retention bracket 50. An interface between the adapter element 54 and the retention bracket 50 may be configured, i.e., designed and constructed for reliable latching of the adapter element to the retention bracket by an individual performing installation/removal of the subassembly. To facilitate such installation/removal, the adapter element 54 and the retention bracket 50 may be configured to require the adapter element to be turned clockwise approximately ¼ turn relative to the retention bracket.

The first, second, third, and fourth seals 52, 56, 68, 72, when placed between the specifically designed components as described above, seal the headlamp assembly 36. Without the first, second, third, and fourth seals 52, 56, 68, 72, the light bulb 60 may fail in the event moisture penetrates the headlamp assembly 36 while the bulb is generating light and hot. Accordingly, the first, second, third, and fourth seals 52, 56, 68, and 72 cooperate to seal the headlamp assembly 36 from moisture that may be encountered by the vehicle 10 during its operation and maintain effectiveness and reliability of the headlamp assembly. Such sealed headlamp assemblies 36 may be especially useful in sport utility or off road vehicles that may be called upon to traverse a body of water.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A headlamp assembly comprising:

a headlamp housing;

a lens affixed to the headlamp housing to thereby define, in conjunction with the headlamp housing, an interior space of the headlamp assembly;

a reflector defining an aperture and arranged within the interior space;

a retention bracket mounted to the reflector;

a first seal attached to the retention bracket for sealing thereof to the headlamp housing and keeping moisture out of the interior space;

an adapter element configured to be selectively fastened to the retention bracket such that an interface between the adapter element and the retention bracket is generated thereby, and unfastened from the retention bracket;

a second seal arranged between the adapter element and the retention bracket, and configured to keep moisture from penetrating the interface between the retention bracket and the adapter element;

a light bulb mounted to the adapter element and configured to extend through the aperture in the reflector toward the lens;

a connector configured to establish an electrical connection to the light bulb for communicating an electric current thereto; and a third seal arranged between the connector and the adapter element and configured to keep moisture from reaching the electrical connection between the light bulb and the connector.

2. The headlamp assembly of claim 1, wherein the adapter element is configured to be pushed into the retention bracket in order to extend the light bulb through the aperture into the reflector and then turned relative to the retention bracket to thereby selectively fasten the adapter element to the retention bracket.

3. The headlamp assembly of claim 2, wherein the adapter element is turned clockwise approximately ¼ turn relative to the retention bracket to thereby selectively fasten the adapter element to the retention bracket.

4. The headlamp assembly of claim 1, wherein the light bulb is mounted to the adapter element via a mounting plate that is fastened to the adapter element.

5. The headlamp assembly of claim 1, wherein the first seal is a bellows.

6. The headlamp assembly of claim 1, wherein the second seal is one of an O-ring and a gasket characterized by a substantially rectangular cross-section.

7. The headlamp assembly of claim 1, wherein the connector is arranged in line with respect to the light bulb.

8. The headlamp assembly of claim 1, wherein the connector is arranged at an angle with respect to the light bulb.

9. The headlamp assembly of claim 1, wherein the connector includes a snap-lock arrangement, and wherein the snap-lock arrangement latches the connector onto the adapter element.

10. The headlamp assembly of claim 1, wherein the connector is coupled to an electrical cable, and wherein the headlamp assembly further comprises a fourth seal configured to seal an interface between the connector and the electrical cable.

11. A vehicle comprising:

a vehicle body;

an energy storage device; and a headlamp assembly including:

a headlamp housing mounted to the vehicle body;

a lens affixed to the headlamp housing to thereby define, in conjunction with the headlamp housing, an interior space of the headlamp assembly;

a reflector defining an aperture and arranged within the interior space;

a retention bracket mounted to the reflector;

a first seal attached to the retention bracket for sealing thereof to the headlamp housing and keeping moisture out of the interior space;

an adapter element configured to be selectively fastened to the retention bracket such that an interface between the adapter element and the retention bracket is generated thereby, and unfastened from the retention bracket;

a second seal arranged between the adapter element and the retention bracket, and configured to keep moisture from penetrating an interface between the retention bracket and the adapter element;

a light bulb mounted to the adapter element and configured to extend through the aperture in the reflector toward the lens;

a connector configured to establish an electrical connection to the light bulb for communicating an electric current thereto from the energy storage device; and a third seal arranged between the connector and the adapter element and configured to keep moisture from reaching the electrical connection between the light bulb and the connector.

12. The vehicle of claim 11, wherein the adapter element is configured to be pushed into the retention bracket in order to extend the light bulb through the aperture into the reflector and then turned relative to the retention bracket to thereby selectively fasten the adapter element to the retention bracket.

13. The vehicle of claim 12, wherein the adapter element is turned clockwise approximately ¼ turn relative to the retention bracket to thereby selectively fasten the adapter element to the retention bracket.

14. The vehicle of claim 11, wherein the light bulb is mounted to the adapter element via a mounting plate that is fastened to the adapter element.

15. The vehicle of claim 11, wherein the first seal is a bellows.

16. The vehicle of claim 11, wherein the second seal is one of an O-ring and a gasket characterized by a substantially rectangular cross-section.

17. The vehicle of claim 11, wherein the connector is arranged in line with respect to the light bulb.

18. The vehicle of claim 11, wherein the connector is arranged at an angle with respect to the light bulb.

19. The vehicle of claim 11, wherein the connector includes a snap-lock arrangement, and wherein the snap-lock arrangement latches the connector onto the adapter element.

20. The vehicle of claim 11, wherein the connector is coupled to an electrical cable, and wherein the headlamp assembly additionally includes a fourth seal configured to seal an interface between the connector and the electrical cable.

* * * * *